United States Patent [19]

Marconi

[11] Patent Number: 4,978,933

[45] Date of Patent: Dec. 18, 1990

[54] WIDEBAND MICROWAVE HYBRID CIRCUIT WITH IN-PHASE OR PHASE-INVERTED OUTPUT SIGNALS

[75] Inventor: Franco Marconi, Monza, Italy

[73] Assignee: Siemens Telecommunicazioni S.p.A., Milan, Italy

[21] Appl. No.: 250,893

[22] Filed: Sep. 29, 1988

[30] Foreign Application Priority Data

Oct. 1, 1987 [IT] Italy ..... 22103 A/87

[51] Int. Cl.[5] ..... H01P 5/16

[52] U.S. Cl. ..... 333/117; 333/136

[58] Field of Search ..... 333/117, 109, 136, 132, 333/134, 126, 129, 127, 128, 120, 123

[56] References Cited

U.S. PATENT DOCUMENTS 3,364,430 1/1968 Goodman et al. ..... 333/117 X
4,238,766 12/1980 Masuda ..... 333/132 X
4,288,766 9/1981 Okita ..... 333/202 X
4,489,292 12/1984 Ogawa ..... 333/202
4,728,792 2/1988 Lampe, Jr. ..... 333/136 X

OTHER PUBLICATIONS

Aikawa et al., "A New MIC Magic-T Using Coupled Slot Lines", IEEE Trans. on Microwave Theory and Techniques, MTT-28, No. 6, Jun. 1980.

*Primary Examiner*—Benny Lee
*Attorney, Agent, or Firm*—Adel A. Ahmed

[57] ABSTRACT

To an output terminal of a hybrid circuit with output signals mutually phase shifted 90 degrees is connected a half-wave line section while to the second output terminal is connected a low attenuation filtering network having a phase characteristic which is −90 degrees at the center frequency and varies with the frequency like a half-wave line section.

9 Claims, 2 Drawing Sheets

WIDEBAND MICROWAVE HYBRID CIRCUIT WITH IN-PHASE OR PHASE-INVERTED OUTPUT SIGNALS

The present invention relates to the field of microwave circuits and more particularly to a wideband microwave hybrid circuit with in-phase or phase-inverted output signals.

Wideband circuits with two input terminals and two output terminals, accomplished with couplers connected in tandem or with Lange couplers, whose output signals are mutually phase shifted by 90 degrees, called hereinafter 90-degree hybrid circuits, are known in the art.

It is also known that if a line section of a length equal to one-quarter of the wavelength of an input signal (hereinafter called a quarter-wave line) is connected to an output terminal of a 90-degree hybrid circuit, there is obtained a hybrid circuit whose output signals are either in-phase or phase-inverted. But this circuit displays the shortcoming of having a narrow bandwidth because as frequency varies around the center frequency fo, the phase shift introduced by the line section varies excessively.

An embodiment of a wideband hybrid circuit with output terminals in-phase or phase-inverted is described in the article by M. Aikawa, and H. Ogawa, "A New MIC Magic-T Using Coupled Slot Lines", IEEE Transactions on Microwave Theory and Techniques, Vol. MTT-28, No. 6, June 1980. This embodiment, however, has the shortcoming of being quite complicated because it calls for circuitry developments on both faces of the substrate with the slot line technique.

The object of the present invention is to overcome the above mentioned shortcomings and indicate a wideband microwave hybrid circuit with in-phase or phase-inverted output signals which is simple to accomplish on microstrip or stripline and is economical.

In accordance with principles of the present invention there is connected to one output terminal of a 90-degree hybrid circuit a section of line of a length equal to one-half of the wavelength of an input signal (called hereinafter a half-wave line section) and to the second output terminal a filter network having a transfer function with an attenuation characteristic which is zero or negligible in a wide range around the center frequency of and with a phase characteristic which is −90 degrees at the center frequency fo and varying with the frequency as in the presence of a half-wave line in such a manner as to compensate for the phase variation introduced by the other branch in a wide range around the center frequency fo, the range which thus establishes the width of the pass-band.

Such a microwave hybrid circuit comprises essentially a wide-band hybrid circuit with output signals mutually phase shifted by 90 degrees. A half-wave line section is connected to an output terminal of said wide-band hybrid circuit. A wide-band filtering network with a phase characteristic which is −90 degrees at a center frequency and which varies with the frequency like that of said half-wave line section, is connected to a second output terminal of said wide-band hybrid circuit.

Other objects and the advantages of the present invention will appear clearly from the detailed description which follows and from the annexed drawings presented merely as explanatory nonlimiting examples wherein.

Figure 1:
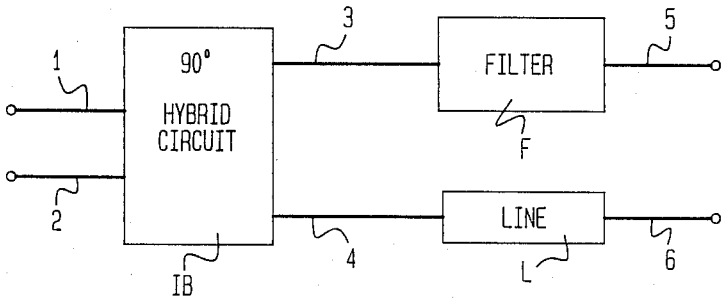
FIG. 1 shows a block diagram of the circuit which is the object of the invention.

In FIG. 1, a 90-degree hybrid circuit IB of known type includes two input terminals indicated by reference numbers 1 and 2 and two output terminals indicated by reference numbers 3 and 4.

At one output terminal, e.g. the one indicated by number 3, there is connected a filter F, having a wide pass-band centered around the frequency fo, with negligible attenuation, which will be discussed in detail below and the output terminal of which is indicated by reference number 5.

At the other IB output terminal, which is indicated by reference number 4, there is connected a half-wave line section L, hence λ/2 long at frequency fo. The output terminal of line section L is indicated by reference number 6.

On the basis of the signal input terminal selected between the two input terminals 1 and 2 there are obtained signals at the output terminals 5 and 6 in-phase or phase-inverted. At the remaining input terminal there is connected, for example, a local oscillator if the hybrid circuit is used as a mixer, or a general matched-impedance network on the basis of the specific application.

Figure 2:
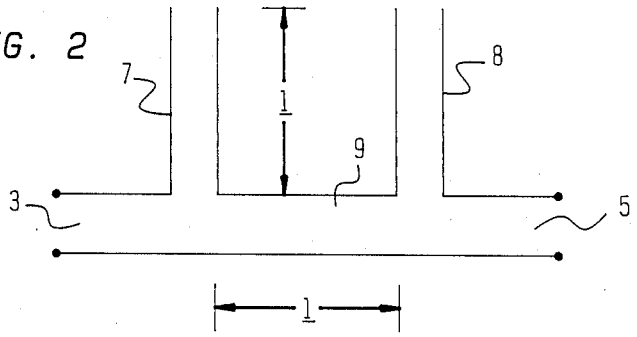
FIG. 2 shows an equivalent circuit of a first example of an embodiment of a filter F of FIG. 1.

FIG. 2 shows an equivalent circuit of a first form of embodiment of the filter F.

The numbers 7 and 8 indicate two equal open stubs in series on a line section 9.

In the art, the term 'stub' means a line section derived in series or parallel from a main line section.

The length l of the stubs 7 and 8, and their separation on line section 9, are both equal to a quarter-wave length at frequency fo. The corresponding electrical length will be indicated by $\theta o$ and defined as:

$$\theta o = l\epsilon r 2\pi fo/C \quad (1)$$

where l is the length of the line section, $\epsilon r$ is the relative dielectric constant of the medium, C is light velocity in a vacuum.

Henceforth Zo will indicate the characteristic impedance of the line section 9. Zoo will indicate the characteristic impedance of the stubs 7 and 8.

An open stub without losses exhibits at its input terminal an input impedance Zi equal to:

$$Zi = -j\, Zoo \cot \theta \quad (2)$$

where $\theta$ is the generic value of the electrical length corresponding to the frequency f.

Since the stub 7 is placed in series on the line section 9 it will give rise thereon to a reflection coefficient Γ which, allowing for equation (2), equals:

$$\Gamma = -j\,Zoo \cot\theta + Zo - Zo / -j\,Zoo \cot\theta + Zo + Zo \quad (3)$$

Rationalizing we have:

$$\Gamma = -j\,2\,Zoo\,Zo \cot\theta + Zoo^2 \cot\theta / 4\,Zo^2 + Zoo^2 \cot^2\theta \quad (4)$$

The ratio between the output voltage Vu and the input voltage Vi at the points of the line section 9 downstream and upstream from the stub 7 respectively is:

$$Vu/Vi = 1 - \Gamma \quad (5)$$

Substituting equation (4) into equation (5):

$$Vu/Vi = 4Zo^2 + j\,2\,Zoo\,Zo \cot\theta / 4Zo^2 + Zoo^2 \cot^2\theta \quad (6)$$

The phase shift $\phi'$ introduced by the stub 7 on the line section 9 is taken from the relationship between the imaginary part and the real part of equation (6).

$$\begin{aligned} \phi' &= \mathrm{Tan}^{-1}(2\,Zo\,Zoo \cot\theta / 4\,Zo^2) \\ &= \mathrm{Tan}^{-1}(Zoo \cot\theta / 2\,Zo) \end{aligned} \quad (7)$$

The same phase shift is introduced by the stub 8.

Hence the total phase shift $\phi$ introduced by the filter of FIG. 2 between the input terminal 3 and the output terminal 5 will be:

$$\phi = 2\phi' - \theta \quad (8)$$

i.e. it is equal to the phase shift introduced by the two stubs 7 and 8 decreased by the contribution due to their separation.

The phase shift introduced by the line section L of FIG. 1 on the other output terminal of the hybrid circuit IB is equal to $-2\theta$.

The total phase difference $\Delta\Phi$ introduced in the paths which extend between points 3 and 5 and between points 4 and 6 of the hybrid circuit of FIG. 1 will be:

$$\begin{aligned} \Delta\Phi &= 2\,\phi' - \theta - (-2\theta) \\ &= 2\phi' + \theta \\ &= 2\,\mathrm{Tan}^{-1}(Zoo \cot\theta / 2\,Zo) + \theta \end{aligned} \quad (9)$$

Figure 3:
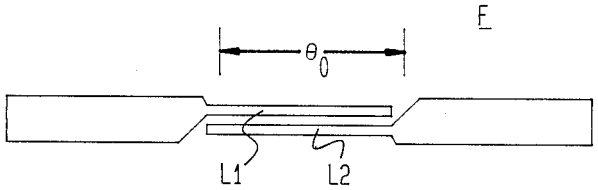
FIG. 3 shows a diagram of the embodiment of the example of FIG. 2.

In FIG. 3 is shown a nonlimiting example of an embodiment of the filter F of FIG. 2 implemented in microstrip form.

Filter F consists of two line sections L1 and L2 coupled in parallel, $\theta$o in length, 0.1 mm in width and 60 $\mu$m apart. L1 and L2 are arranged along the line section, interrupting it.

In addition, for the example described in FIG. 3, the following electrical parameters relative to the stubs are applicable: Zoo=46Ω and Zoe=146Ω; where Zoo is the characteristic impedance of the odd mode, which is identified with the characteristic impedance of the above-defined stub and Zoe is the characteristic impedance of the even mode.

Figure 4:
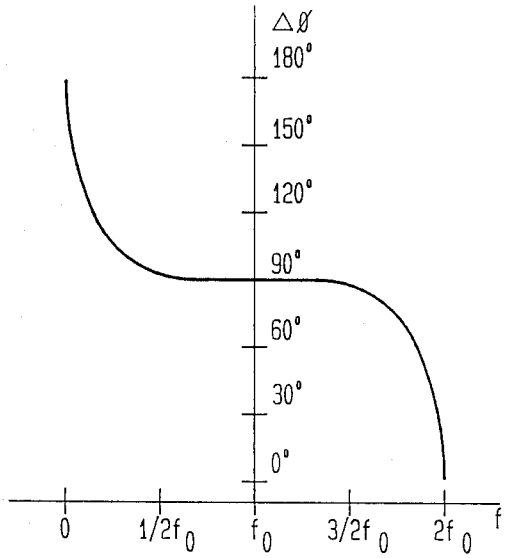
FIG. 4 shows a chart of the curve of a phase difference introduced by the filter F and the line section L of the circuit shown in FIG. 1 versus the frequency deviation from center frequency.

Substituting the above numerical values into equation (9) there is obtained a curve of the phase difference $\Delta\Phi$ versus the frequency f as shown in FIG. 4. To obtain the curve of the phase difference between the signals at output terminals 5 and 6 of the hybrid circuit of FIG. 1, from the curve shown in FIG. 4, there must be added or subtracted (in case of output terminals 5 and 6, which are, respectively, phase-inverted and in-phase) that of the phase difference introduced by the hybrid circuit IB (FIG. 1) which is assumed to be a constant 90 degrees in the band in question.

If it is desired, for example, to maintain the phase error between the two output terminals 5 and 6 of the hybrid circuit within ±3 degrees in relation to the center frequency condition, with reference to FIG. 4, it is seen that a relative band of 90% is obtained.

It is clear that numerous variants are possible to the embodiment described above without thereby exceeding the scope of the innovative principles inherent in the inventive idea.

Figure 5:
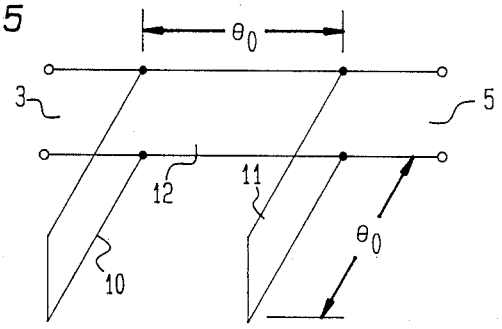
FIG. 5 shows an equivalent circuit of a second example of the embodiment of the block F of FIG. 1.
Figure 6:
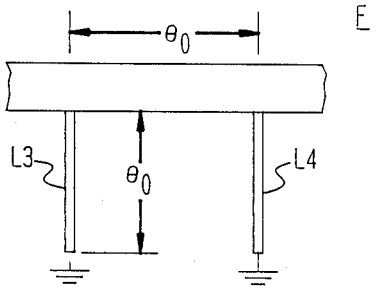
FIG. 6 shows a diagram of the embodiment of the example of FIG. 5.

For example the filter F of FIG. 1 can be made by means of a parallel structure which is the dual of the preceding structure. Such a dual structure is shown in FIGS. 5 and 6. Theoretical considerations which are the duals of those discussed above are applicable to the structure of FIGS. 5 and 6. These considerations lead to establishment of an equal curve of the phase difference $\Delta\Phi$ shown in FIG. 4.

FIG. 5 shows the equivalent circuit of such a parallel structure. Reference numbers 10 and 11 indicate two equal short-circuited stubs placed in parallel on a line section 12. Their length and separation on the line section 12 is equal to $\theta$o.

FIG. 6 shows an example of an embodiment of the parallel microstrip structure which is the dual to that shown in FIG. 3. Line sections L3 and L4 are two line sections which produce the short-circuited stubs 10 and 11 of FIG. 5. Line sections L3 and L4 are arranged perpendicularly to the line section, are placed $\theta$o apart, are $\theta$o long and have their free ends grounded.

The circuits shown in FIGS. 5 and 6 are more difficult to produce because they occupy a larger portion of space in the microstrip structure.

The circuits shown in FIGS. 3 and 6 can also be produced by the 'stripline' technique without substantial changes in their structure.

What I claim is:

1. A wide-band microwave hybrid circuit, comprising:

a wide-band hybrid circuit, having first and second input terminals for having an input signal applied thereat, and first and second output terminals, for producing respective signals at said output terminals mutually phase shifted by 90 degrees over a wide frequency band;

a half-wave line section having a first phase characteristic varying over the wide frequency band, said line section being one half-wave length long at a center frequency of said wide frequency band, a first end of said half-wave line section being coupled to the first output terminal of said wide-band hybrid circuit; and a wide-band filtering network, with input and output terminals, having a second phase characteristic varying over the wide frequency band between said input and output terminals of said wide-band filtering network, the input terminal of said wide-band filtering network being coupled to the second output terminal of said wide-band hybrid circuit; wherein:

said second phase characteristic exhibits a signal phase shift between said input and output terminals of said wideband filtering network of −90 degrees at the center frequency of said wide frequency band, varying over the frequency band like said first phase characteristic in said wide frequency band, and causes a phase-difference between the output terminal of said wide-band filtering network and a second end of said half-wave line section wherein said phase difference is substantially flat over a range of frequencies in said wide frequency band.

2. The microwave hybrid circuit of claim 1, wherein:

said substantially flat phase-difference between the output terminal of said wide-band filtering network and the second end of said half-wave line section, is respectively zero and 180 degrees for a signal respectively applied at the first input terminal and a signal respectively applied at the second input terminal of said wide-band hybrid circuit.

3. The microwave hybrid circuit of claim 1, wherein said filtering network comprises:

a further line section; and two equal length open stubs coupled respectively at first and second ends of said further line section, the length of said open stubs, and their separation on said further line section, being equal to one-quarter wavelength at said center frequency of said wide frequency band.

4. The microwave hybrid circuit of claim 1, wherein:

said filtering network comprises an interrupted central portion of a first line section placed between input and output terminals of said filtering network, and a second and a third line section respectively coupled at two end portions of said central portion;

wherein both said second and third line sections have respective lengths which are one-quarter wavelength at said center frequency of said wide frequency band, and both said second and third line sections have respective widths which are less than a width of said first line section; and said second and third line sections are placed parallel to each other in a direction of said central portion of said first line section.

5. The microwave hybrid circuit as in claim 4 wherein all of said line sections are in microstrip form.

6. The microwave circuit as in any one of claims 4 and 5, wherein said second and third parallel quarter-wave line sections have a width of 0.1 mm and a relative distance of 60 $\mu$m.

7. The microwave hybrid circuit of claim 1, wherein said filtering network comprises:

a fourth line section, coupled between said input and output terminals of said filtering network; and two equal length short-circuited stubs coupled respectively at the input terminal end and at the output terminal end of said fourth line section, the lengths of said short-circuited stubs, and their separation on said fourth line section, being equal to one-quarter wavelength at said center frequency of said wide frequency band.

8. The microwave hybrid circuit of claim 7, wherein said short-circuited stubs are comprised of a fifth and a sixth quarter-wave line section respectively placed perpendicularly to said fourth line section in said filtering network at a relative distance equal to one-quarter wavelength at said center frequency, said fifth and sixth line sections each having first ends coupled to the fourth line section and second ends connected to ground.

9. The microwave hybrid circuit as in claim 8, wherein all of said line sections are in microstrip form.

* * * * *